United States Patent [19]

Rogers

[11] Patent Number: 5,048,137

[45] Date of Patent: Sep. 17, 1991

[54] EDGE-SHEAR REDUCTION IN BODY SUPPORT FOAM PADS

[76] Inventor: John E. Rogers, P.O. Box 1437, Blue Jay, Calif. 92317

[21] Appl. No.: 570,220

[22] Filed: Aug. 20, 1990

[51] Int. Cl.[5] ..... A47C 27/14

[52] U.S. Cl. ..... 5/464; 5/461; 5/481

[58] Field of Search ..... 5/461, 464, 468, 481

[56] References Cited

U.S. PATENT DOCUMENTS

| | | | |
|---|---|---|---|
| 1,548,728 | 8/1925 | Milam | 5/462 |
| 2,659,418 | 11/1953 | Berman | 5/464 X |
| 2,763,013 | 9/1956 | Valkenburgh | 5/464 X |
| 2,953,195 | 9/1960 | Turck, Jr. | 5/481 X |
| 3,885,257 | 5/1975 | Rogers | 5/464 |
| 4,955,096 | 9/1990 | Gilroy et al. | 5/464 |

*Primary Examiner*—Michael F. Trettel

*Attorney, Agent, or Firm*—Natan Epstein

[57] ABSTRACT

Shear stress on the skin is relieved at cavity edges in a resilient foam pad by cavity walls shaped to define a region of diminished support under the cavity edge. The edge material yields more easily under loading and may roll into the cavity to avoid pressing into body tissues. The interior wall or walls of the cavity are slanted outwardly to undercut all or part of the cavity edge to reduce the thickness of material under the edge. The shape and curvature of the cavity and cavity walls can be adapted and tailored to achieve particular pressure gradients and patterns.

12 Claims, 2 Drawing Sheets

EDGE-SHEAR REDUCTION IN BODY SUPPORT FOAM PADS

BACKGROUND OF THE INVENTION

1. Field of the Invention

The present invention relates generally to resilient pads, and the like for supporting the human body in a seat or on a bed, and more particularly relates to improvements in foamed material pads intended to better distribute pressure on the skin to avoid injury and in particular to prevent formation of decubitus ulcers, also known as bed sores.

A great deal of effort has been expended to devise and improve pads of various types to distribute as evenly as possible the pressure exerted on the body of a person resting thereon. The irregular shape and weight distribution of the human anatomy causes certain portions of the body to carry a disproportionate pressure load when the body is supported on a plane surface, even if that surface is quite resilient. In a bed-ridden person resting supine on a horizontal, uniform surface, areas of high local pressure are typically found at the back of the heels, the sacrum area, and the back of the head. In a side position, areas of peak pressure typically occur in the hip bone or trochanter area in contact with the supporting surface.

Protracted pressure against any portion of the skin has the effect of diminishing or cutting off peripheral vascular flow to that area. If impairment of blood flow to the affected area is sufficiently prolonged, the tissues underlying the affected skin area will be starved of nutrients and suffer progressive damage. Typically it is the underlying soft tissues which are first damaged, until eventually the skin undergoes necrosis and ulcerates in progressive manner, and unless the pressure on the area is removed, such ulcers can become deep open wounds which are difficult to treat and slow to heal.

It is known to make apertures or holes in a foam pad to accommodate and relieve pressure against anatomical protuberances. For example, one or more circular holes can be located on the pad to underlie the coccyx of the patient. Other holes can be placed under the head, the heels, and generally under any bony protrusion susceptible to ulceration or damage during protracted confinement to bedrest or a chair. Such holes in prior foam pads have been characterized by straight interior walls, that is, walls which are perpendicular to the foam pad surface, regardless of the shape of the hole opening on the pad surface. The response of the pad surface to weight loading in the vicinity of such a straight walled hole is influenced somewhat by the hole, since the pad material is deprived of support at the interior wall defined by the hole. A load placed on the top surface in the vicinity of a straight walled hole may find less support than the same load placed at a point further removed from the hole because in the former case the foam material is able to bulge into the hole and thus yields more readily. At the pad surface however, the edge of the hole remains relatively well supported and can press into the skin tissues of a person lying thereon. Because of the relatively sharp transition in pressure against the tissues at the edge, a straight walled opening or cavity in the support surface of the foam pad can cause the skin and underlying tissues to extrude into the hole. This sharp transition creates shear stress in the skin and underlying tissues which tends to accelerate breakdown and eventual ulceration of the tissues. What is needed therefore is a means to reduce or eliminate shear stress in the tissues of a patient at the edge of holes or cavities in a foam pad, so that holes and cavities can be better used to relieve skin pressure and conform the pad surface to anatomical protuberances and irregularities.

Still another benefit of this invention resides in improved control over edema, the accumulation of fluid in tissues which extrude into a hole or depression in the supporting surface. In the improvement of this invention, the cavity edge becomes depressed and rounded when under load, the tissues are largely prevented from extruding into the cavity thus reducing the likelyhood of edema and consequent tissue damage.

SUMMARY OF THE INVENTION

It is the object of the present invention to reduce the shear stresses imposed on the anatomy of the user at the edge of an opening in the support surface of a foam pad. The present invention offers a means for better controlling shear stress at support surface discontinuities, such as at hole edges and transitions into surface depressions, cavities, and such. In prior art pads shear stress control has been achieved by cutting or slicing the surface of the foam pad at or near edges and discontinuities. The present invention provides a means for controlling shear stress at such discontinuities while retaining a continuous solid volume of foam material around openings and cavities for better strength and wear.

According to the invention here disclosed, a body support comprising a pad of resilient material having a top surface for supporting a human body, has an open cavity for relieving pressure on a portion of the human body, the cavity having an edge at the top surface, the cavity being shaped and configured so as to define a zone of graded body pressure along an uncut continuous region of the top surface adjacent to the edge thereby to relieve shear stress on the body at the edge. In particular, the cavity may enlarge under the edge to define a ledge adapted to roll into the cavity under loading by the person's body bearing on the top surface to produce a zone of graded pressure against the body adjacent to the edge thereby to relieve shear stress on the body at the edge. More particularly, the cavity in the pad may have a narrow end open at the top surface for admitting a portion of the human body such as a body protuberance, the cavity widening under the open end such that pad material adjacent the edge of the open end tends to roll into said cavity under pressure of the body to relieve shear stress on the body at edge. The cavity may be open at a bottom surface of the pad to form a through-hole in the pad. The cavity may have a closed bottom or and open bottom either of which is larger than the open top end of the cavity with sloping walls connecting the open top and the bottom. The open top and the bottom may assume a variety of shapes including circular, rectangular, polygonal or irregular shapes, with corresponding modification to the interior walls of the cavity. For a circular top and bottom, the interior wall may be frustoconical. For rectangular top and bottom, the cavity interior may have four trapezoidal walls defining a pyramidal cavity. One or more of the interior walls or any portion thereof may be straight and vertical, with only part of the cavity defined by sloping, angled walls. Further, the walls may be straight in elevational cross-section, or may be curved. The elevational curvature of the walls in turn may be either convex or concave, and different portions of the walls may have different curvatures to obtain tailored gradients of resilience and response to pressure loading of the pad top surface in the vicinity of the cavity edge.

It is understood that, while reference is made to a single opening or cavity in the foam pad in the interest of clarity of explanation, more than one such opening or cavity can be provided in a single pad as may be needed or desired for any particular purpose, nor do all such opening in a given pad be identical to each other. Different cavity configurations may be adapted to different anatomical portions throughout a particular pad. The term pad generally includes pads of samll size for chair use and larger pads for bed use. These and other features and advantages of this invention will be better understood from the following detailed description and attached drawings.

DETAILED DESCRIPTION OF THE PREFERRED EMBODIMENTS

Figure 1:
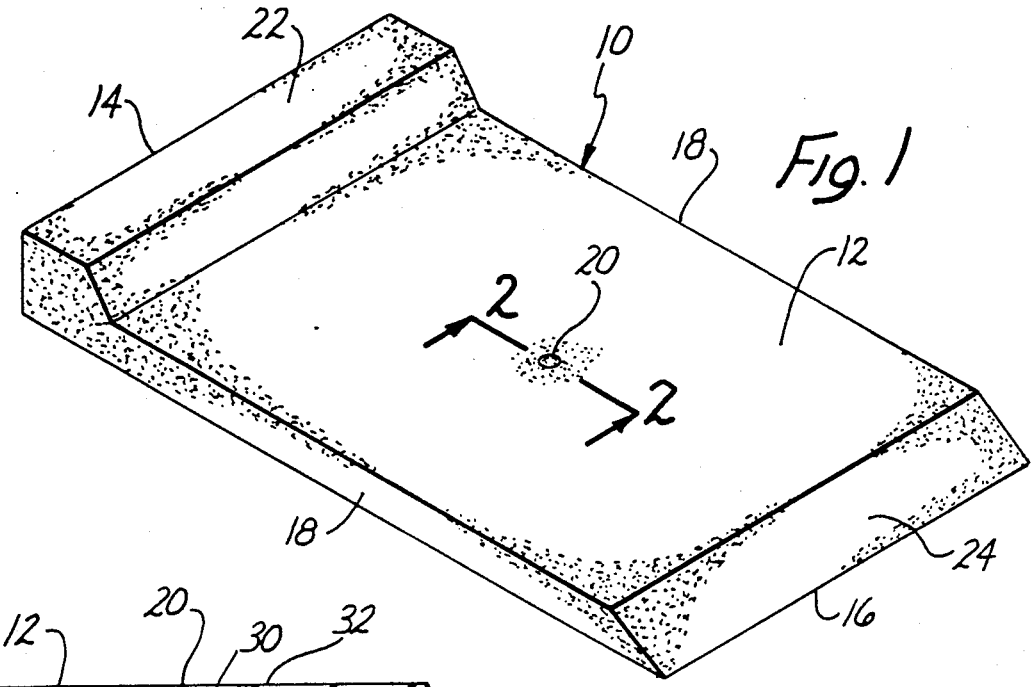
FIG. 1 is a perspective view of a typical bed size pad provided with a coccigeal relief aperture according to this invention.
Figure 2:
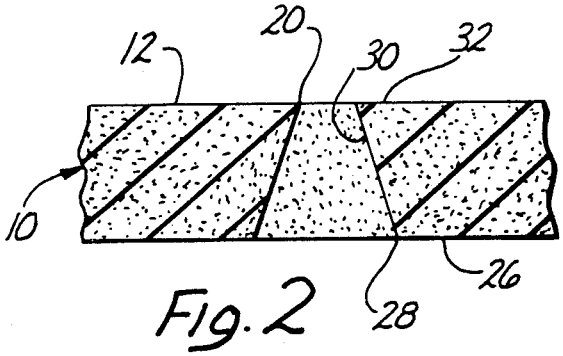
FIG. 2 is an elevational cross-section taken along line 2—2 in FIG. 1 showing the tapered wall of the relief aperture.
Figure 4:
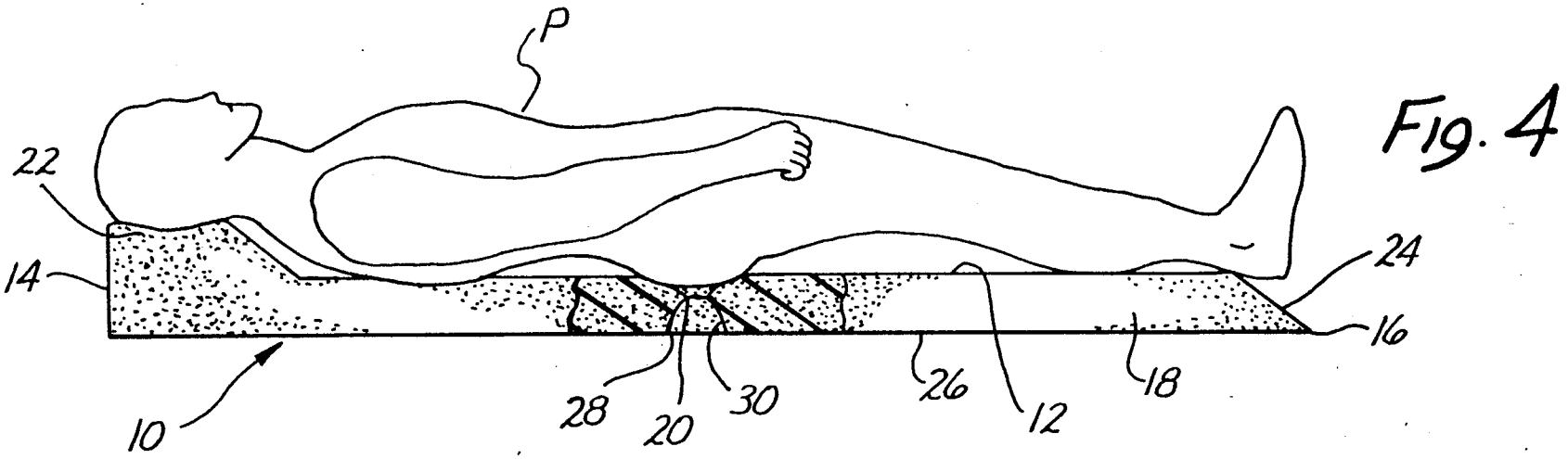
FIG. 4 is a side view of the pad of FIG. 1 with a person supported thereon in supine position.

With reference to the drawings, FIGS. 1 and 2 show a rectangular pad 10 having an upper, body supporting surface 12 extending between a head end 14, foot end 16 and two sides 18. The pad 10 is made of a resilient synthetic foam material selected from various such foams in current use for similar applications. In FIGS. 1 and 4 the pad 10 is shown to have an integral head-elevating raised shelf 22, and the foot end has a sloping surface which tapers from the top surface 12 to an edge 16. The sloping surface 24 relieves pressure against the heels of a person P lying on the pad 10 as shown in FIG. 4 of the drawings.

The central area of the top surface 12 has an opening 20 centered between the sides 18 and located so as to underlie the coccigeal area of an average individual lying in a normal supine position on the pad surface 12, as in FIG. 4. The opening 20 will also underlie the hip bone projection of the same individual lying on his or her side and stretched generally along the center-line of the pad between the two sides 18.

The opening 20 is to relieve pressure against the bony protrusions of the coccyx and the hip bone of a person confined to bed rest for protracted periods of time, to avoid breakdown and ulceration of the skin over these bony protrusions.

The opening 20 is the top aperture of a frustoconical through-hole defined by interior walls 30 and shown in vertical cross section in FIG. 2. The hole 30 extends fully through the thickness of the pad 10 between the top surface 12 and the bottom surface 26 of the pad. Both top and bottom openings 20, 28 are circular, but the top opening 20 is substantially smaller than the lower opening 28.

Consequently, the cross sectional dimension or area of the hole increases from top to bottom and the interior wall 30 of the through-hole is frustoconical. The wall 30 recedes outwardly away from the edge of the top opening 20 with increasing depth away from the top surface 12, thereby undercutting a circumferential zone 32 of the pad surface 12 immediately adjacent to the edge of the top opening 20. The radial extent of the zone 32 is a function of the angle of the interior wall 30 and the pad thickness. Because of the slope angle of the inner wall 30, the thickness of foam material underlying the surface 12 diminishes with proximity to the edge of the top opening 20, beginning at a point on surface 12 overlying the rim of the bottom opening 28, on the undersurface 26. Generally, the zone 32 defines a gradient of diminishing support at the surface 12 as a function of proximity to the opening 20.

Beginning at some point sufficiently removed from the top opening 20, the frustoconical through-hole 30 has negligible effect and the resilience and yielding characteristics of the foam pad are dictated by the nature of the material and the thickness of the pad. As the edge of hole 20 is approached, the deformation of surface 12 under load will be increasingly influenced by the internal geometry of the through-hole 30 and the region 32 of support surface 12 surrounding the through-hole yields with increasing ease. The lack of foam material directly underlying the hole edge allows the foam material to roll inwardly into the hole under loading, as illustrated in FIG. 3.

The present invention reduces shear force on skin tissues at the edge of the hole by undermining the support available at the surface 12 in the vicinity of the edge of the top opening 20. This diminished support is achieved by modifying the interior geometry of the hole or cavity. In particular this may be achieved by slanting the interior wall 30 of the cavity or hole outwardly so as to form an acute angle, i.e., less than 90 degrees, between the wall 30 and the surface 12 at the hole edge.

Figure 3:
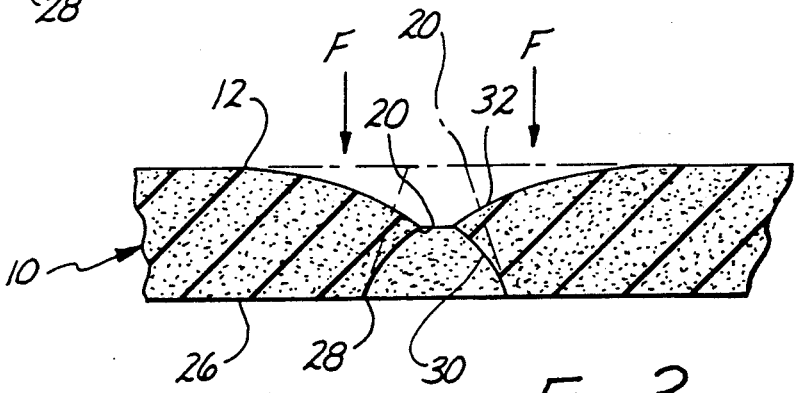
FIG. 3 shows a typical configuration of the pad in the vicinity of the relief aperture under load.

FIG. 3 illustrates typical response of the support surface 12 under load around the opening 20. The load (not illustrated) is indicated by arrows F and is approximately evenly distributed around the opening 20 on surface 12, as might be applied by the body of a person resting on the surface 12, particularly with an anatomical protuberance projecting into the opening 20. Such a condition is illustrated in FIG. 4 where the coccyx projection of the person P is shown overlying the opening 20 of the cavity 30. Under load, the circumferential region 32 of surface 12 rolls into the cavity 30 and the edge of the top opening 20 is depressed below its normal, unloaded condition shown in dotted line in FIG. 3. The edge of opening 20 is deprived of underlying resiliency to an extent controlled by the interior geometry of the hole and the shear effect against any overlying anatomy is diminished accordingly. Since the area of surface 12 immediately adjacent to the hole 20 is pushed down more readily, there is less opportunity for anatomical tissues to extrude into the cavity 30 at the cavity edge. The reduced support gradient around the opening 20 allows any anatomical protuberance and surrounding anatomy to more easily shape and depress the surface 12 around the opening 20 into a depression to a shape generally conforming to the anatomy with relatively low shear and extrusion at the opening 20.

Figure 5:
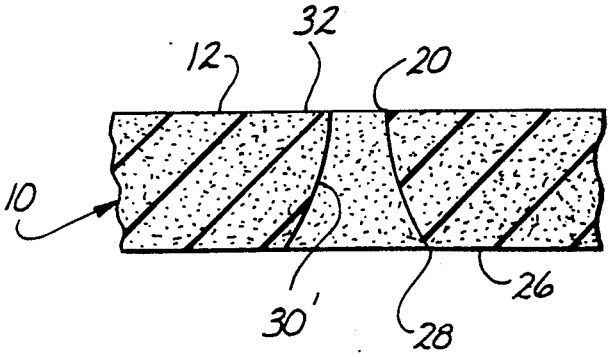
FIG. 5 is an elevational cross-section taken as in FIG. 2 showing a variation where the relief aperture has convexly curved inner walls.
Figure 6:
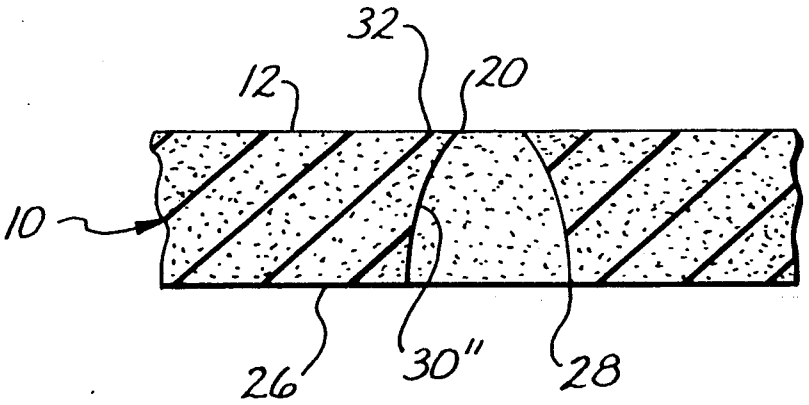
FIG. 6 is an elevational cross-section taken as in FIG. 2 showing a variation where the relief aperture has concavely curved inner walls.

Low edge-shear openings in the pad surface 12 as just described can be achieved with a variety of cavity geometries, some of which are shown in FIGS. 5 and 6. The cavity 30 in FIG. 2 has straight, outwardly slanting inner walls which, for a circular top and bottom openings will define a frustoconical through-hole in the pad. The openings 20, 28, however, need not be circular but may assume an arbitrary shape, with corresponding changes in the interior wall 30. For example, square openings 20; 28 may be employed with trapezoidal interior walls connecting corresponding sides of the top and bottom openings, resulting in a pyramidal shaped cavity.

FIG. 5 shows a low edge-shear cavity where the interior widens at a non-uniform rate with increasing depth so that in cross-section the inner wall 30' is convexly curved. The rate of curvature at different depths of the cavity can be tailored and adjusted to obtain specific characteristics of the support gradient in the zone 32 adjacent to the top opening 20. Thus, a convex curvature shaped as in FIG. 5 will provide an initial drop-off in support at a point somewhat removed from the edge of the hole 20 with a lesser subsequent reduction as the edge of the hole 20 is approached because the walls near the top, i.e., near the edge of the hole 20, more closely approach a straight, vertical wall and provide firmer support at the hole rim. Conversely, a softer edge can be obtained by increasing the slant of the curve away from the vertical near the edge, i.e. a more acute angle between wall 30' and surface 12 at the hole edge.

FIG. 6 shows yet another variation where the interior cavity wall 30'' is concavely curved between the top opening 20 and bottom opening 28. The wall deviates from the vertical most pronouncedly near the top opening 20 and then curves towards the vertical as it approaches the bottom surface 26. Consequently, the degree of support provided to the surface 12 in region 32 diminishes rapidly as the edge of the opening 20 is approached, producing a very soft, easily deformable zone near the opening edge, with rapidly firmer support being encountered as the distance away from the opening 20 increases. The curved walls 30' and 30'' in FIGS. 5 and 6 respectively provide variations from a more linear gradation in support characteristics provided by the straight sloping wall 30 of FIG. 2.

It will be understood that the invention is not limited to the particular shapes and configurations here described or illustrated in the drawings, and that many slopes and elevational curvatures of the cavity wall 30 can be implemented to achieve various support gradient characteristics around an opening 20 in the support surface 12 of the pad 10. Further, the sloping cavity wall need not extend about the entire circumference or perimeter of the top opening 20. For example, a half-circular portion of the top opening 20 may be supported by a straight, vertical inner wall, while the opposite half circle 20 may have a sloping underlying wall 30. In a rectangular opening, two opposite sides may be associated with slanted interior walls while the remaining two sides may be associated with vertical cavity walls. Still other combinations of straight sloping, concave, or convex cavity walls may be provided in a single cavity of arbitrary shape. The dimensions of the openings are not critical and may vary to suit their purpose. For a coccigeal opening such as illustrated in the drawings, the top opening may be two inches in diameter and the bottom opening may be four inches in diameter in a pad about three inches thick. In the pad 10 several cavities 30 with top and bottom openings as shown can be grouped in a straight line to accomodate the coccygeal region of different sized users. Various factors, which may be experimentally determined, will influence the dimensions of the cavity and the slope and shape of the cavity walls. In particular, the cavity design will take into account the resilience of the particular foam material, which are available in a variety of hardnesses and resiliencies.

The top opening 20 may also be vanishingly small, so that the support surface is essentially uninterrupted, but will overlie a cavity shaped as described above, e.g., a conical cavity having a pointed apex at the supporting surface. Such a cavity will provide generally similar benefits to those having an open top. The surface 12 over the cavity will yield to accomodate anatomical protrusions and will offer a pressure gradient around the cavity which will depend on the size and shape of the cavity, as well as on the resiliency characteristics of the foam material.

The improvement of this invention does not require that the cavity have a bottom opening 28 at an under surface 26 of the pad 10. The bottom of the cavity may be closed by a second layer of foam adhesively affixed to the under surface 26 of a top pad layer. In the alternative, the cavity may be formed so as to have a closed bottom in a single layer of foam. These and other combinations and modifications to the present invention will become apparent to those possessed of ordinary skill in the art in light of the foregoing description and attached drawings which are for purposes of illustration and explanation only and not by way of limitation of the scope of the following claims.

What is claimed is:

1. A body support pad of resilient foamed material, said pad having a top surface between two pad ends and two sides, a single cavity in said pad located in a central area of said pad, said cavity opening at said top surface for relieving pressure against the coccygeal or hip bone region of a person supported on said top surface, said opening having an edge at said top surface and an interior wall connected with said edge, characterized in that at least a portion of said wall is inclined away from the vertical to undercut said edge and define a region of diminished support at said top surface adjacent to said edge thereby to reduce shear stress on said anatomical portion at said edge.

2. The pad of claim 1, characterized in that said wall is shaped so that the cross sectional dimension of said cavity in a plane parallel to said top surface increases in a direction away from said top surface to undercut said edge and allow said edge to roll into said cavity in response to loading of said top surface thereby to reduce shear stress on said anatomical portion at said edge.

3. The pad of claim 2, said cavity having a narrow end open at said top surface for relieving pressure on a portion of the human body, said cavity having a cavity interior of wider dimension under the open narrow end such that pad material adjacent an edge of the open end projects into the cavity and tends to roll into said cavity under pressure of said body to produce a zone of graded pressure thereby on the body to relieve shear stress on the body at said edge.

4. The body support of claim 3 wherein said pad has a bottom surface opposite said top surface and said cavity is open at said bottom surface.

5. The pad of claim 1 wherein said pad also has a bottom surface and said cavity is a through-hole between said top and bottom surfaces opening at each said surface, said through-hole having a top perimeter and a bottom perimeter respectively, said wall connecting said perimeters, characterized in that at least a portion of said wall widens outwardly to undercut at least a corresponding portion of said top perimeter such that the undercut portion of said top perimeter yields to body pressure on said top surface by rolling into said through-hole thereby to relieve the body of shear stress at said perimeter.

6. The pad of claim 5 wherein said top perimeter is a smaller circle and said bottom perimeter is a larger circle and said wall widens in frustoconical shape between said perimeters.

7. The pad of claim 5 wherein said perimeters are circular and said wall widens convexly between said perimeters.

8. The pad of claim 5 wherein said perimeters are circular and said wall widens concavely between said perimeters.

9. The pad of claim 5, characterized in that said top perimeter is smaller than said bottom perimeter.

10. The pad of claim 1, characterized in that at least part of said cavity enlarges under said edge to define a ledge adapted to roll into said cavity under body pressure bearing on said top surface and produce a zone of graded support against the body adjacent to said edge thereby to relieve shear stress on the body at said edge.

11. The pad of claim 1 having means defining a zone of graded resilience of said foamed material along an uncut continuous portion of said top surface adjacent to said edge thereby to relieve shear stress on the body at said edge.

12. A body support pad of resilient material having a top surface for supporting a human body, a single cavity in a coccygeal supporting region of said pad for partially admitting a protuberant anatomical portion of a human body supported thereon for relieving pressure on said anatomical portion of the human body, said cavity having a rim at said top surface, the interior of said cavity being shaped and configured for defining a zone of graded pressure exerted against said human body by an uncut continuous area of said top surface adjacent to said rim thereby to relieve shear stress on the body at said rim, said graded pressure diminishing with proximity to said rim.

* * * * *